United States Patent [19]

Godfrey, Jr.

[11] 4,313,435

[45] Feb. 2, 1982

[54] APPARATUS AND METHOD OF PRODUCING A SUCCESSION OF DIE CUT TOBACCO BLANKS

[75] Inventor: Frederick D. Godfrey, Jr., Maple Wood, N.J.

[73] Assignee: Gulf & Western Corporation, New York, N.Y.

[21] Appl. No.: 141,333

[22] Filed: Apr. 18, 1980

[51] Int. Cl.[3] ..... A24C 1/28

[52] U.S. Cl. ..... 128/105; 83/511

[58] Field of Search ..... 131/105, 32–35, 131/36, 59, 23 R, 20 R; 83/510–512, 267, 100, 152, 155, 733, 552

[56] References Cited

U.S. PATENT DOCUMENTS

| | | | |
|---|---|---|---|
| 1,775,026 | 9/1930 | Aamwi | 83/267 X |
| 2,157,536 | 5/1939 | Halstead | 131/49 |
| 2,613,674 | 10/1952 | Giles | 131/102 |
| 3,199,514 | 8/1965 | Petri et al. | 131/133 |
| 3,222,967 | 12/1965 | Godfrey | 83/100 |
| 3,512,436 | 5/1970 | Jacobsberg | 83/100 |
| 3,542,036 | 11/1970 | Hooper et al. | 131/33 |
| 3,542,038 | 11/1970 | Hooper et al. | 131/149 |
| 3,591,044 | 7/1971 | Hooper | 221/73 |
| 3,939,740 | 2/1976 | Johnson | 83/24 |
| 4,025,914 | 5/1977 | Anderson et al. | 356/239 |
| 4,094,325 | 6/1978 | Stoffers | 131/21 R |
| 4,128,214 | 12/1978 | Maas | 131/149 X |
| 4,246,911 | 1/1981 | Boogers | 131/149 |

FOREIGN PATENT DOCUMENTS

| | | | |
|---|---|---|---|
| 568989 | 7/1958 | Belgium | 83/512 |
| 871787 | 5/1979 | Belgium . | |
| 876972 | 12/1979 | Belgium . | |
| 873770 | 4/1981 | Belgium . | |
| 929942 | 3/1966 | Canada | 83/511 |
| 108960 | 6/1960 | Netherlands . | |
| 7712589 | 11/1977 | Netherlands . | |
| 7902987 | 6/1981 | Netherlands . | |

*Primary Examiner*—Stephen C. Pellegrino

*Attorney, Agent, or Firm*—Meyer, Tilberry & Body

[57] ABSTRACT

A device for supplying a succession of die cut tobacco blanks with a given profile to a web of a coiled type, storage bobbin. This device comprises a set of die cut stations each including a cutting die blade with an upstanding cutting edge matching the profile of the proposed blank and vacuum means surrounding the edge of the blade for capturing a tobacco sheet material on the stations in a position overlying the cutting edge. The stations are moved along an endless, preselected cutting path which intersects a cutting means at a first position in the path of movement of the stations so that a tobacco leaf can be cut from a manually placed tobacco sheet captured on the movable station. After passing the cutting means, which includes two rolls generally fixed in the direction of movement of the station, the station continues in the same endless path to a transfer position at which position the cut profile is released from the cutting station and is transferred to an awaiting web of a coiled type storage bobbin.

19 Claims, 6 Drawing Figures

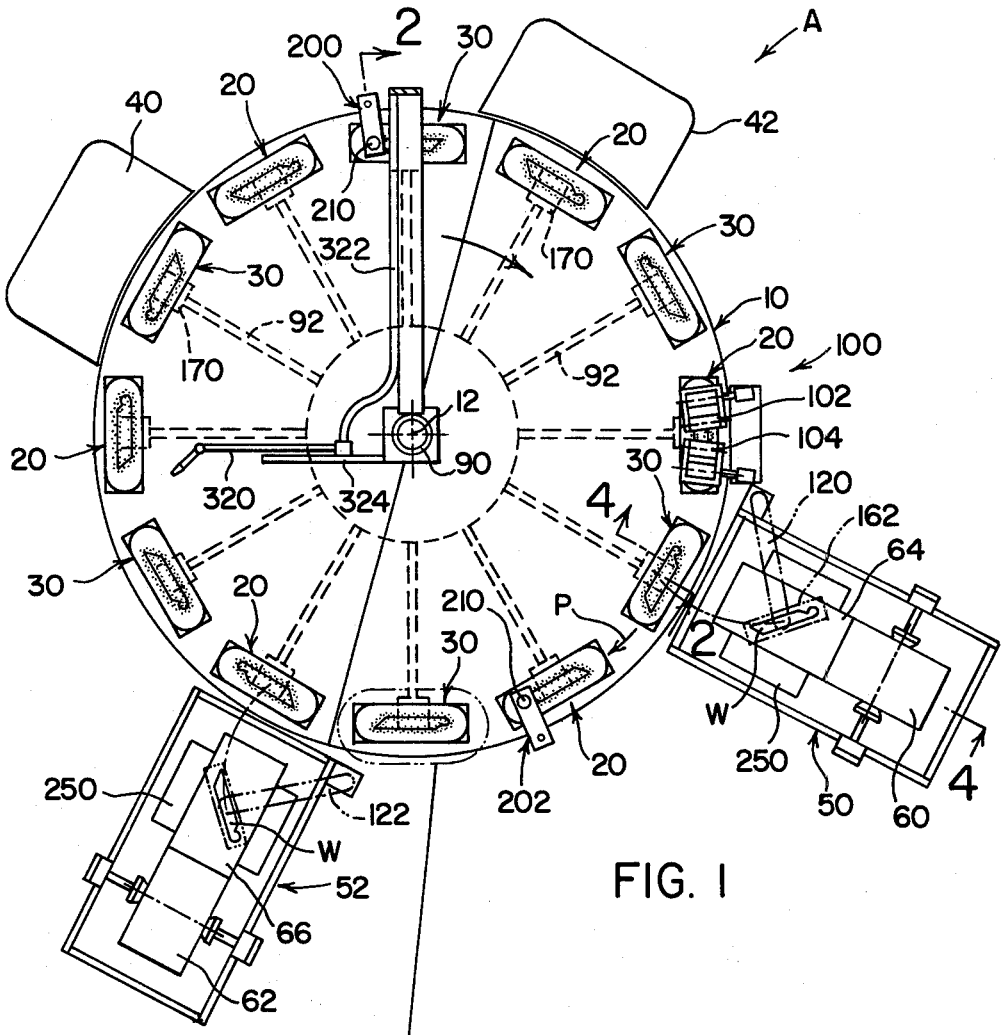
FIG. 1
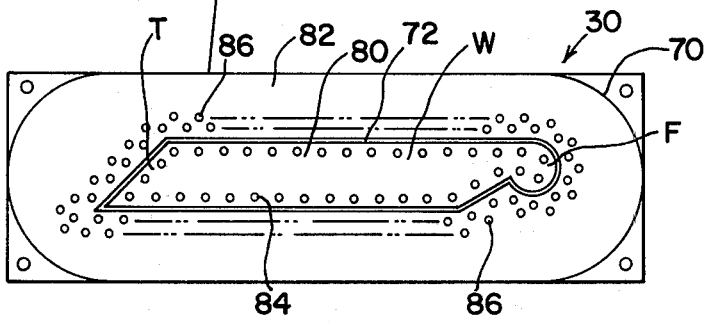

3
3
30
L
142
140
72
152
170
154
160
184
186
180
182
188
188
100
104
350
102
352
356
360
354
92
30
72
B
90
12
16
14
A
10
92
200
210
216
30
72
218
212
L
142
140
B

APPARATUS AND METHOD OF PRODUCING A SUCCESSION OF DIE CUT TOBACCO BLANKS

The invention relates to the art of processing tobacco leaves and more particularly to an apparatus and method of supplying or producing a succession of die cut tobacco blanks, such as cigar wrappers, for use in the coiled type of storage bobbin now extensively used in the cigar manufacturing art.

The invention is particularly applicable for producing the outer wrapper of a cigar which is stored in a bobbin for subsequent wrapping about a cigar body and will be described with particular reference thereto; however, it is appreciated that the invention is somewhat broader and may be used in making other tobacco profiles, such as binders for cigar bunches.

BACKGROUND OF THE INVENTION

In producing cigars, an outer wrapper cut from a natural tobacco leaf is often spirally wound about the cigar to produce the appearance familiar to the buying public. For many years the wrapper was cut and spirally wrapped around a cigar in a single manually operated machine which cut the wrapper and performed the wrapping operation. This type of machine was relatively slow and had a high labor input in that an operator had to position the wrapper preparatory to cutting and then had to wait for completion of the cutting and wrapping operation. In recent years there has been a tremendous effort devoted to mechanizing the production of cigars. All phases of cigar manufacturing are now the subject of development work directed toward increased mechanization. Only in this manner can a cigar be produced at a cost commensurate with the general market conditions. In this continuing effort to mechanize cigar manufacturing, it has become quite popular to cut the wrapper at a remote position and store a large number of cut wrappers in a manner which will allow mechanized feeding of the wrapper into a wrapping position. One of the more common storage systems involves the use of a fabric web coiled into a cylinderical bobbin. Wrappers are cut and deposited onto the web which is then wrapped to capture the cut wrapper between convolutions of the bobbin. A bobbin filled with wrappers equally spaced throughout the convolutions is then used in an automatic feeding mechanism that reverses the loading action of the bobbin. The web is unwound to expose a series of oriented, spaced wrappers that are transferred, in succession, to the wrapping machine.

The use of a coiled web in the form of a bobbin to capture and store wrappers has introduced a further problem of mechanization. At this time, the bobbin is loaded with cut wrappers by various systems. One of the systems involves the use of an operator positioned before a cutting die having a cutting blade shaped into the desired profile of the wrapper. A natural tobacco leaf is laid over the cutting die in a manner avoiding defects and vacuum is applied to the cutting die. This holds the leaf in place so that a cutting roller can roll over the die and cut the wrapper from the leaf. Thereafter, the roll returns to the rest position, a transfer arm lifts the cut wrapper and the wrapper is moved to a web of a bobbin. After these functions have been performed, the operator repositions the leaf to provide a second wrapper, if possible, and the procedure is repeated. In this manner, a succession of wrappers are deposited onto the web which is intermittently indexed to capture the wrappers between the convolutions of the bobbin which is being wound. After a bobbin has been filled, it is transferred to a storage area to be used in various types of wrapping machines. As can be seen, this somewhat standard procedure is highly labor intensive. The operator must wait for the cutting rolls to roll over the die and return for the wrapper transfer to be made before the die is then again ready for cutting another wrapper. This is the background of the tobacco art to which the present invention is directed.

THE INVENTION

The present invention relates to an apparatus and method for mechanizing the process of cutting cigar wrappers from natural tobacco leaves preparatory to the wrappers being stored in a web type bobbin. The present invention substantially reduces the labor costs in the process of producing wrappers for storage in bobbins to be subsequently used in cigar wrapping machines. In accordance with the present invention, a single operator can produce between twenty-five and thirty wrappers per minute for storage in a bobbin. Since cigars are high production products, the slight saving of labor cost per cigar is highly magnified; however, such savings must be balanced with the development costs and dependability of a machine for reducing labor input. The present invention is relatively simple and can be produced at a relatively low cost and operated dependably over long periods. This renders the invention highly desirable for the unique problems presented in producing competitively priced cigars.

In accordance with the present invention, there is provided an apparatus for supplying a succession of die cut tobacco blanks with a given profile, such as wrappers, to a web of a coiled type storage bobbin. This device comprises a set of die cut stations each including a cutting die blade with an upstanding cutting edge matching the profile of the wrapper and vacuum means surrounding the edge for capturing a tobacco sheet material on the station in a position overlying the cutting edge, means for moving the stations along an endless, preselected path, cutting means at a first selected, generally fixed position in the path for cutting a tobacco blank from a manually placed tobacco sheet, or leaf, captured on a station by the aforementioned vacuum means as a station passes the first preselected position. The cutting means includes a roller generally fixed in the direction of the path and engageable with the cutting edge as the station passes the first position. A profile releasing means is provided at a second selected, generally fixed position in the path and subsequently located in the path with respect to the first position for releasing a die cut profile from a station at this second position and transfer means at the second position for transferring a die cut profile, or wrapper, from its station to the web of a coiled type storage bobbin. This apparatus therefore provides a fixed roller under which a cutting station passes as it moves from a position where an operator places a tobacco leaf over the cutting blade to a outlet position where a transfer takes place. Consequently, the operator need not wait on the cutting operation and the transferring operation before a subsequent station is presented for positioning a second leaf over the cutting edge. In this manner, a number of stations continuously move in a preselected path. At one position in the path the operator places a leaf in a desired position where it is held by vacuum. As the station is then indexed beyond the operator, it passes a fixed cutting roller and progresses on to a transfer means which lifts the released wrapper from the cutting station and deposits it on a waiting web which is subsequently coiled in the fashion described above into a bobbin for storage of the wrapprs until used in a cigar wrapping machine.

In accordance with another aspect of the invention, two rollers are employed for the cutting operation. In this manner, a station passes under two separate and distinct cutting rollers which are individually biased against the cutting edge of a cutting blade. This produces a dual cutting step to assure separation of the wrapper from the leaf being held onto the cutting station. Since the second cutting roll is in the path of movement of a cutting station, it does not require additional time to apply two or more cutting operations to assure positive separation of the wrapper from its leaf.

In accodance with still a further aspect of the invention, there is provided an auxiliary cutting means for cutting a predetermined portion of the wrapper overlying a predetermined portion of the die blade in the cutting station. As is known, wrappers often include a tuck end and a flag end. The flag end is a curved tail that is wrapped around the mouth end of the cigar. By providing a reciprocable plunger having a lower resilient surface in the path of movement of the cutting station, the plunger can be reciprocated downwardly against the flag end of the cutting blade to assure the complex cutting operation at this particular position. Such auxiliary cutting of the wrapper can take place before or after the primary cutting rollers. This adds versatility and provides positive assurance that the flag portion of the wrapper is severed from the leaf to prevent tearing of the fragile flag end of the wrapper during the transfer operation. Only by using the inventive concept of the present invention can this auxiliary cutting take place without adding to the total cycle time of producing a wrapper for storage in a standard type of bobbin.

In accordance with another aspect of the present invention, there are two sets of cutting stations carried on a common table and used by two separate operators. In this manner, a single indexing mechanism can be used by two operators. In addition, only a single position needs to be used for cutting in that a single roll or set or rolls can be used to cut the wrapper from the cutting stations in each of the two sets being indexed in unison along the same transfer path. In accordance with this aspect of the invention, only a single indexing structure, station moving structure and cutting operations need to be used for the production generated by two operators. Thus, a single machine can be used for producing both left and right hand wrappers if desired. Of course, separate transfer and bobbin arrangements are used for each of the operators.

In accordance with another aspect of the present invention, there is provided an arrangement for the operator to indicate that a particular station, after a wrapper has been cut therefrom, has an exhausted or spent leaf. In this manner, the spent leaf can be discharged from the apparatus at a selected position. This particular arrangement can be used with two operators so that a single discharge arrangement for spent leaves can be employed in the apparatus.

In accordance with a still further aspect of the present invention, there is provided a method of operating a device as defined above. This method can be broadly defined as including the steps of manually applying a tobacco leaf over a cutting die having a blade with a profile matching the desired profile of a wrapper, moving the leaf and cutting die in a given direction along a preselected path, forcing a first roller against the leaf and blade as the leaf and blade move in a given direction past a given position in the path whereby a wrapper is cut, continuing movement of the wrapper and cutting die in the given direction in the path and then removing the cut wrapper from the cutting die at a subsequent position in the path. In accordance with the invention, the transfer operation and the manual applying operation take place simultaneously and may be separated by one or more wrappers being processed. In this manner, high production rates can be obtained by relatively simple procedures.

The primary object of the present invention is the provision of a method and apparatus for producing a succession of die cut tobacco blanks with a given profile to be used in a coiled type storage bobbin, which method and apparatus can produce the profiles at a relatively high speed, involves a reduction in labor costs per cut, and are reliable in use.

A still further object of the present invention is the provision of a method and apparatus, as defined above, which method and apparatus further mechanizes the production of low cost, high volume cigars.

These and other objects and advantages will become apparent from the following description taken together with the drawings set forth in the following section.

BRIEF DESCRIPTION OF THE DRAWINGS

In this disclosure, the following Figures are employed:

FIG. 1 is a schematic top view showing the preferred embodiment of the present invention;

PREFERRED EMBODIMENT

Figure 2:
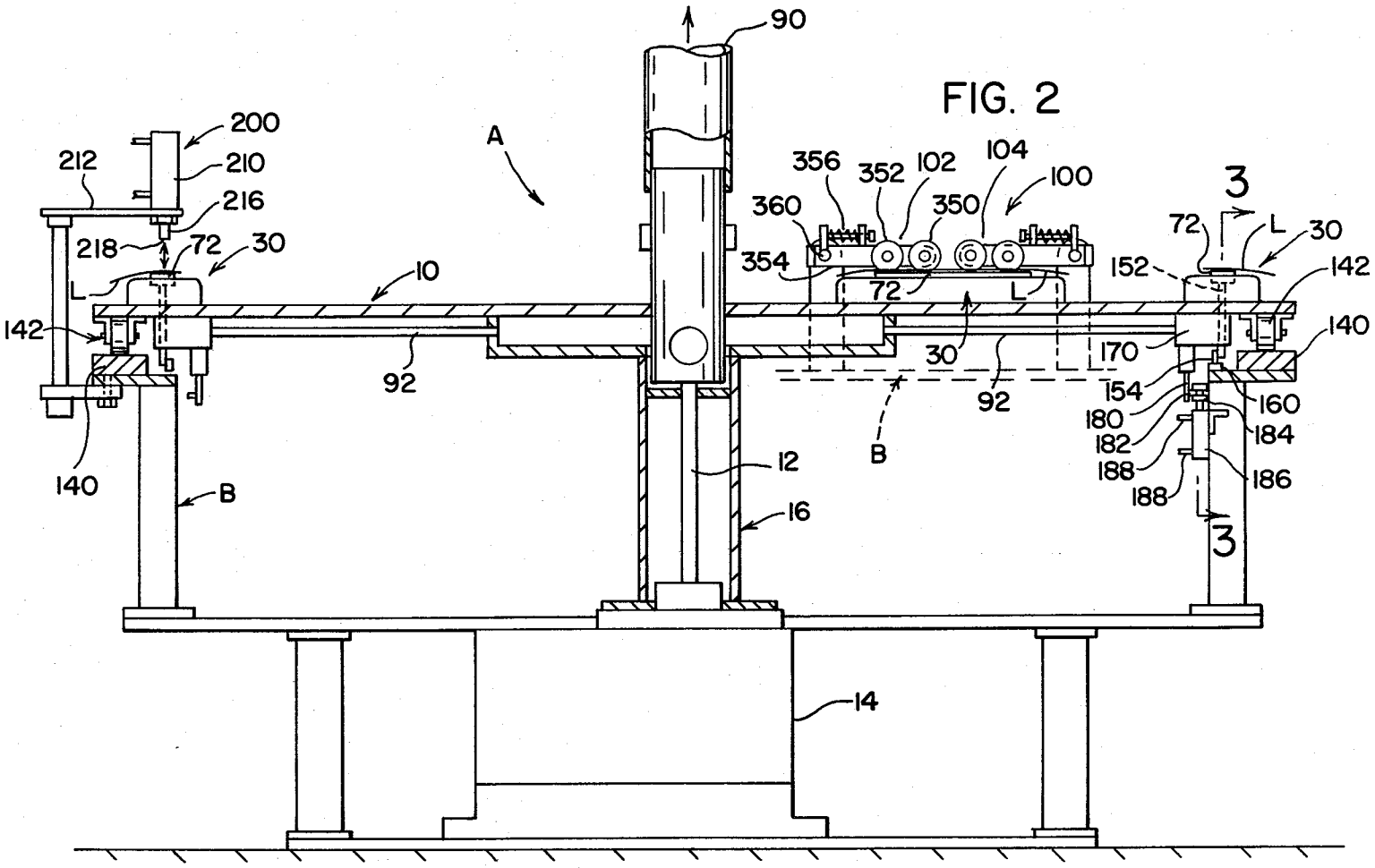
FIG. 2 is an enlarged schematic cross-sectional view taken generally along line 2—2 of FIG. 1.

Referring now to the drawings which are for the purpose of illustrating a preferred embodiment of the invention and not for the purpose of limiting same, FIGS. 1 and 2 show an apparatus A for cutting a succession of cigar wrappers W from a natural tobacco leaf, which apparatus includes a table 10 indexable about a vertical axis 12 by an appropriate index driving arrangement 14 connected to the table through a shaft 16. Drive 14 indexes table 10 through 60° at which time there is a dwell. Any appropriate drive arrangement could be provided for this purpose. The amounts of dwell in relation to the indexing time can also be adjusted. In practice, the dwell is approximately sixty percent of the total cycle which is approximately thirty indexes per minute. A first set of cutting stations 20 for cutting wrappers of a selected hand are circumferentially spaced around axis 12 for indexing along an endless path A. These stations are spaced from each other 60°. In like manner, a second set of stations 30 are provided for cutting wrappers of a different hand and spaced from each other a distance of 60° for movement in unison with stations 20 along endless path P. Since two sets of stations are employed, a station is provided at each 30° even though the indexing is through 60°. Two operators at locations 40, 42 are employed for laying a stemmed or unstemmed natural tobacco leaf over one of the cutting stations for subsequent cutting into a wrapper W. Bobbin winders 50, 52 of substantially standard design are employed for removing cut wrappers and storing them in bobbins 60, 62, respectively. The webs 64, 66 are wrapped in convolutions to form the bobbins 60, 62, respectively. Apparatus A is employed for cutting wrappers to be deposited on webs 64, 66 and stored in the respective bobbins 60, 62.

Each of the stations 20, 30 are substantially the same except one is right handed and the other is left handed as determined by the position of the flag end F and the tuck end T. By describing one station 30, best shown in the enlarged portion of FIG. 1 and in FIG. 3, this description will apply equally to the other stations. Each station includes a hollow housing 70 in which is positioned a somewhat standard cutting blade 72 having an outwardly extending cutting edge 74 forming the contour of the wrapper to be cut. A vacuum holding means 80 is positioned within blade 72 and vacuum holding means 82 is positioned outside the blade. Ports 84, 86 are provided in vacuum holding means 80, 82, respectively. These ports are along the profile of blade 72 to support a leaf over the blade for the cutting operation. An operator places a leaf in position and then vacuum is applied to housing 70 for holding the natural tobacco leaf in the desired position for subsequent cutting. An appropriate vacuum supply means 90 directs vacuum to a plurality of radially extending vacuum lines 92, each of which is directed to one of the stations 20, 30. When vacuum is applied to the station, a leaf or wrapper is held to the station. By an appropriate valving arrangement not illustrated, vacuum in each of the lines 92 can be selectively controlled so that vacuum is released from the station when the leaf is to be removed, in a manner to be described later. Also, vacuum to the interior holding means 80 can be individually controlled for releasing a wrapper from a station at the wrapper transfer position determined by the location of bobbin winding mechanisms 50, 52, respectively.

To cut a wrapper from a leaf captured by vacuum on a station 20, 30, there is provided a cutting station 100 having two separately biased rollers 102, 104. These rollers are biased downwardly toward the stations so they engage the upwardly extending cutting edge 74 of blade 72 of each station as the station passes below the rolls or rollers. Each of the rolls are independently adjustable to provide the desired orientation to allow cutting of both a left hand and right hand wrapper at a single cutting position. By providing two independently adjustable, independently biased rolls 102, 104 at a cutting station, each station is passed under two cutting rolls during its indexing between the operator stations 40, 42 and the transfer stations dictated by the position of bobbin mechanisms 50, 52. Both sets of stations 20, 30 move along the endless path P from the operator stations 40, 42 to the wrapper transfer positions, which positions are separated from the operator locations by cutting stations 100.

In general operation, an operator places a leaf on the station which dwells in front of the operator. Vacuum captures the leaf and holds the leaf in position for cutting by rollers 102, 104 during subsequent indexing of table 10. After the wrapper has been cut, it is released from the station and transferred to web 64 or web 66 by an appropriate transfer arm or mechanism 120, 122, best shown in FIG. 4. As can be seen, the operator only needs to position the leaf over the cutting station and await the next cutting station. The wrapper cutting and transfer operations do not hinder the manipulations by the operator. When a single wrapper has been cut from a leaf, the leaf is held onto the station until it returns to the operator. At that time, the operator moves the leaf to a new position to obtain a second wrapper, if possible. After no further wrappers can be obtained from a given leaf or half leaf, the operator then provides the signal in accordance with the structure schematically illustrated in FIGS. 5 and 5A, so that the spent leaf after the last cutting operation is discharged from table 10, in a manner to be described later. Thus, the operator need only position the leaf or shift the position of the leaf on the station as the station dwells at one of the locations 40, 42. This is the general operation of the preferred embodiment of the present invention and illustrates the advantages of utilizing the invention to cut wrappers on stations moving along a preselected endless path. The path is illustrated as circular, however, other endless paths could be provided for moving stations 20, 30.

Figure 3:
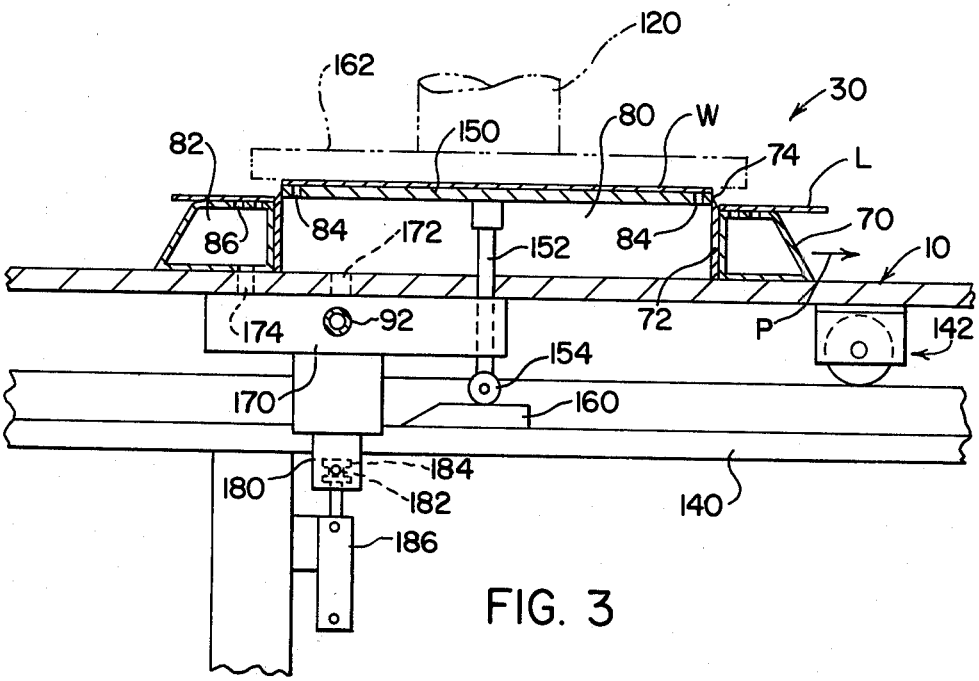
FIG. 3 is an enlarged cross-sectional view showing details of the cutting stations employed in the preferred embodiment of the present invention.

Referring now more particularly to FIGS. 2 and 3, device A has a fixed, circular support ring 140 along which twelve equally spaced support roller assemblies 142 can ride. This supports the indexing movement of table 10. When the table has indexed a station, such as station 30, to the wrapper transfer position as shown in FIG. 3, wrapper W is to be removed while the remainder of leaf L is to be held onto the upper surface of the station. In accordance with another aspect of the present invention, this transfer action is facilitated by modifying vacuum means 80 to include a vertically movable generally flat plate 150 within blade 72. This plate is supported on a depending stem 152 having a lower cam roller 154. As the station moves into the position shown in FIG. 3, cam roller 154 rides over a fixed cam 160 supported on the upper surface of ring 140 and radially spaced inwardly of roller assemblies 142. As cam follower 154 rides over cam 160, plate 152 is raised to a position above cutting edge 74 so that a flat transfer plate 162, best shown in FIG. 4, can capture a cut leaf. To release the vacuum within vacuum means 80 without affecting the vacuum within means 82, there is provided a valve block 170 supported on the table 10 for each of the stations. This block is connected to vacuum line 92 and includes ports 172, 174 communicated with vacuum means 80, 82, respectively. A valve plate 180 depends from block 170 and includes a lower driving element 182 which is captured within head 184 when station 30 moves into position shown in FIG. 3. When in this position, an air valve 186 which is fixed at the wrapper releasing position and receives control signals through air lines 188, is actuated to shift blade 180 upwardly. This blocks vacuum from port 172 while allowing vacuum to continue within port 174. Thus, the vacuum is released from the lower side of plate 150 so that wrapper W can be transferred by the transfer plate 162. In operation, vacuum is released from wrapper W and plate 150 is raised at the transfer position to facilitate transfer of the wrapper to the bobbin web.

Referring now again to FIG. 1, in accordance with another aspect of the invention there are provided two flag cutters 200, 202. These cutters provide an auxiliary cutting action at the flag portion F at stations 30, 20, respectively. Each of these cutting devices is substantially the same; therefore, only cutter 200 will be described in detail. This description applies to cutter 202. A cylinder 210 as best shown in FIG. 2 is supported on a plate 212 fixed on the frame B of device A. Cylinder 210 reciprocates plunger 216 in the direction of the arrows in FIG. 2 which are aligned with the flag portion of blade 72. A generally flat, resilient covered end 218 of plunger 216 engages the blade the cause positive cutting at the flag portion. As shown in FIG. 1, cutter 200 operates at an indexed position prior to cutting station 100 while cutter 202 operates subsequent to the cutting station. In either case, flag cutters 200, 202 provide auxiliary cutting at the complex flag end of wrappers W.

Figure 4:
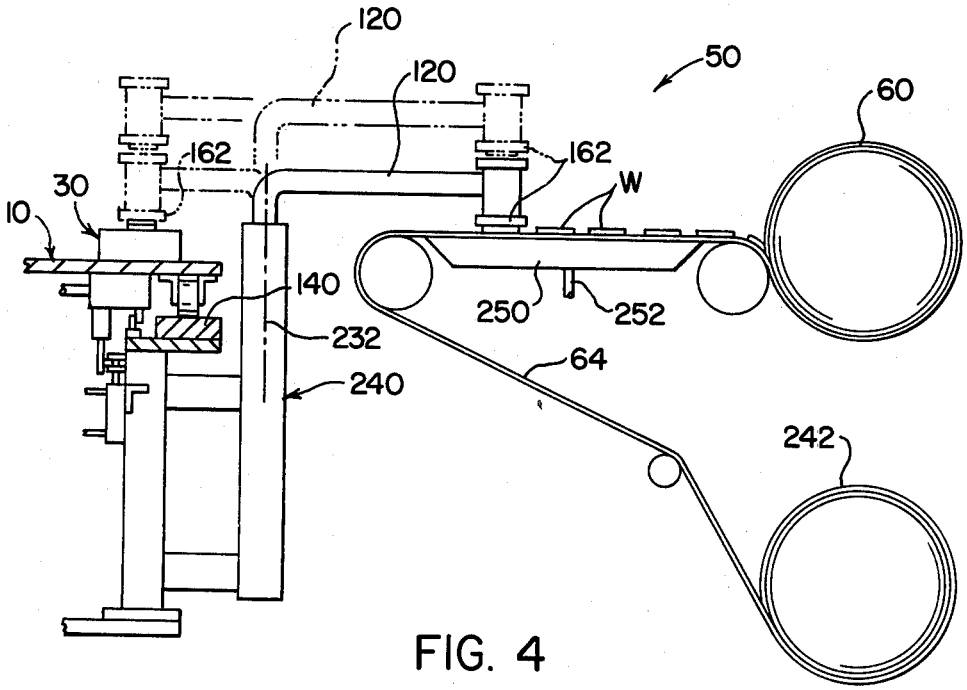
FIG. 4 is a side elevational view showing, somewhat schematically, the transfer mechanism illustrated in FIG. 1.
Figure 5:
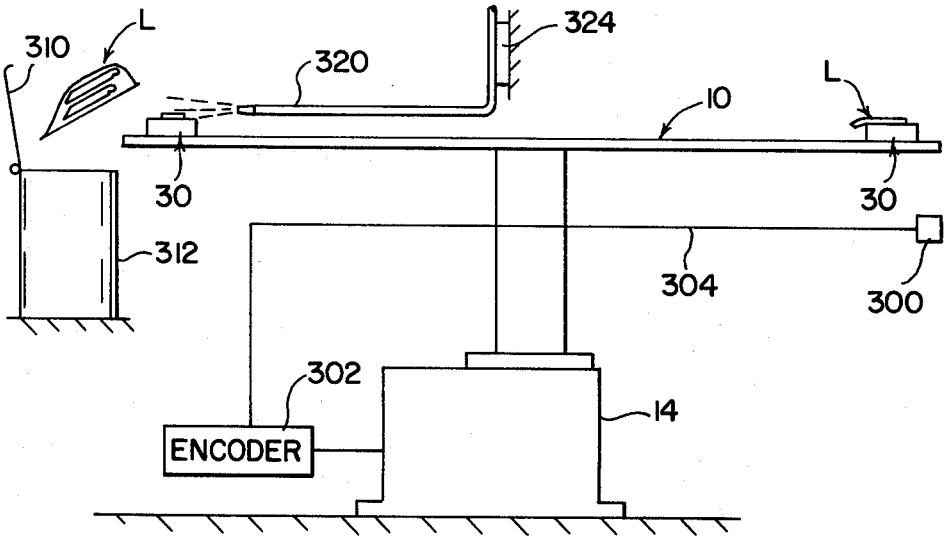
FIG. 5 is an enlarged, schematic view showing a further aspect of the present invention; and, FIG. 5A is a view similar to FIG. 5 showing modification of the structure illustrated in FIG. 5.
Figure 5A:
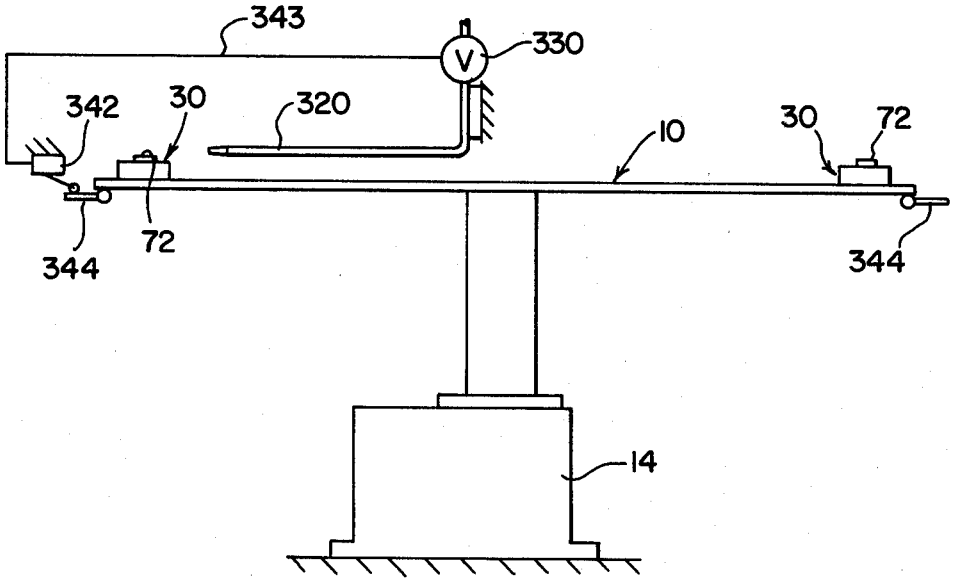

Referring now to FIG. 4, various arrangements could be used for transferring a cut wrapper from a cutting station to web 64 or web 66. In the illustrated embodiment, arm 120 is pivoted about axis 232 by an appropriate mechanism 240. This mechanism also reciprocates arm 120 in a known fashion to pick up and deposit a wrapper. An appropriate web supply reel 242 provides material onto which the wrapper is deposited. An appropriate vacuum box 250 maintains a vacuum on web 64 until the web is wrapped into bobbin 60 for capturing the deposited, spaced wrappers. An appropriate vacuum source 252 is used to supply vacuum to box 250 in accordance with normal practice. As previously mentioned, an operator signals when a station contains a leaf that will be spent after the next cut. In a preferred embodiment, a button 300 is depressed by the operator to indicate such a station. This directs a signal to an encoder 302 through a line 304. This encoder is driven in unison by drive unit 14 to memorize the position at which a signal was received through line 304. As shown in FIG. 5, there is provided a baffle 310 and a container 312 at the position of an air jet 320, best shown in FIG. 1. This air jet receives pressurized air from line 322 and is supported on a fixed plate 324. Encoder 302 operates a valve, not shown, when a station having a spent leaf L moves past air jet 320. This blows the spent leaf L from the station and into container 312 as schematically illustrated in FIG. 5. In FIG. 5A, a modification of the concept illustrated in FIG. 5 is shown, wherein air jet 320 controlled by valve 330 is actuated when a switch 342 provides a signal in line 343. Switch 342 is operated by a movable lever 344 which is shifted into the operative position by an operator when the station aligned with lever 344 will include a spent leaf after the cutting operation. By an arrangement not shown, lever 344 is cammed into the inoperative position after actuating switch 342. FIGS. 5 and 5A illustrate various types of arrangements for indicating when air jet 320 is to be actuated during movement of stations 20, 30 in path P.

As previously mentioned cutting station 100 includes two independent roller units 102, 104. In practice, each of these units is a standard die cutting component of the type moved back and forth over a wrapper die. In each of these components, as shown in FIG. 2, two parallel rollers 350, 352 are mounted in a frame 354 which is biased toward stations 20, 30 by springs 356. Frane 354 is pivoted on shaft 360 fixed onto support frame B.

Having thus described the invention, the following is claimed:

1. A device for supplying a succession of die cut tobacco blanks with a given profile to a web of a coiled type, storage bobbin, said device comprising: a set of a plurality of die cut stations each of said plurality of stations including a cutting die blade with an upstanding cutting edge matching said profile and vacuum means surrounding said edge for capturing a tobacco sheet material on said station in a position overlying said edge; means for moving said set of stations in unison along an endless, preselected path; cutting means at a first selected, generally fixed position in said path for cutting a tobacco blank from a manually placed tobacco sheet captured on a given station of said set by said vacuum means as a station passes said first selected position, said cutting means including a roller generally fixed in the direction of said path and engageable by said cutting edge as a station passes first selected position; profile releasing means at a second selected, generally fixed position in said path and subsequently located in said path with respect to said first position for releasing a die cut profile from a station at said second position; transfer means at said second position for transferring a die cut profile from its station to said web of a coiled type storage bobbin and a fixed loading position for placing a tobacco sheet onto one of said stations of said set, said loading position being spaced from said first and second positions.

2. A device as defined in claim 1, further including an auxiliary cutting means for cutting a predetermined portion of said profile overlying a predetermined portion of said die blade, said auxiliary cutting means including a member spaced from said path and means for forcing said member against said cutting edge of said predetermined portion of said die blade.

3. A device as defined in claim 2, including means for locating said auxiliary cutting means in said path and ahead of said first position.

4. A device as defined in claim 2, including means for locating said auxiliary cutting means in said path and behind said first position.

5. A device as defined in claim 2, wherein said member is a plunger with a resilient lower pad and said forcing means is a fluid operated cylinder receiving said plunger.

6. A device as defined in claim 1, including a second set of a plurality of die cut stations substantially identical to said stations of said first set and alternately positioned with respect to said stations of said first set, said second set of stations being movable in unison with said first set in said preselected path and a second profile releasing means at a third selected, generally fixed position in said path and subsequently located in said path with respect to said first position for releasing a die cut profile for a station of said second set at said third position; a second transfer means at said third position for transferring a die cut profile from a station of said second set to a second coiled type storage bobbin; and another fixed loading position for placing a tobacco sheet onto one of said stations of said second set, said another loading position being spaced from said first, second and third positions.

7. A device as defined in claim 6, wherein said station moving means is a table rotatable about an axis and said path is generally circular and concentric with said axis.

8. A device as defined in claim 7, wherein said moving means is a means for simultaneously indexing said stations of said first set between positions including said second position and said second set between positions including said third position.

9. A device as defined in claim 1, wherein said station moving means is a table rotatable about an axis and said path is generally circular and concentric with said axis.

10. A device as defined in claim 9, wherein said moving means is a means for indexing said stations between positions.

11. A device as claimed in claim 1, wherein said profile releasing means includes means for deactivating at least part of said vacuum means at said second position.

12. A device as defined in claim 1, including means for discharging a spent tobacco sheet at a preselected discharge position in said path and manually operated means for actuating said discharge means when a selected station is at said discharge position.

13. A method of producing a succession of die cut wrappers with a given profile from natural tobacco leaves, said method comprising the steps of:

(a) manually applying a first tobacco leaf over a first cutting die having a blade with a profile matching said given profile at a first position while a second leaf is being manually applied over a second cutting die at another first position;

(b) moving said two leaves and cutting dies in a given direction along a path from said first positions;

(c) forcing a first roller against said leaves and the blade of a cutting die as a leaf and blade moves in said given direction past a given position in said path and spaced from said first positions whereby a wrapper is cut;

(d) continuing movement of said cut wrapper and cutting die in said given direction in said path;

(e) then, removing said cut wrapper from said cutting die at a subsequent position in said path spaced from said first positions and given positions; and, (f) simultaneously performing step (a) for two subsequent leaves while step (e) is being performed on leaves previously subjected to step (a).

14. In a device for supplying a succession of die cut tobacco blanks with a given profile to a web of a coiled type, storage bobbin, said device comprising: a die cut station including a cutting die blade with an upstanding cutting edge matching said profile and vacuum means surrounding said edge for capturing a tobacco sheet material on said station in a position overlying said edge; cutting means for cutting a tobacco blank from a manually placed tobacco sheet captured on said station by said vacuum means, said cutting means including a roller engageable by said cutting edge as a station and roller are moved with respect to each other; profile releasing means for releasing a die cut profile from said station; and transfer means for transferring a die cut profile from said station to said web of a coiled type storage bobbin, the improvement comprising: an auxiliary cutting means for cutting a predetermined portion of said profile overlying a predetermined portion of said die blade, said auxiliary cutting means including a member spaced from said station and means for forcing said member against said cutting edge of said predetermined portion of said die blade before operation of said transfer means.

15. The improvement as defined in claim 14 wherein said member is a plunger with a resilient lower pad and said forcing means is a fluid operated cylinder receiving said plunger.

16. A device for supplying a succession of die cut tobacco blanks with a given profile to a web of a coiled type, storage bobbin, said device comprising: a set of die cut stations each including a cutting die blank with an upstanding cutting edge matching said profile and vacuum means surrounding said edge for capturing a tobacco sheet material on said station in a position overlying said edge; means for moving said stations along an endless, preselected path; cutting means at a first selected, generally fixed position in said path for cutting a tobacco blank from a manually placed tobacco sheet captured on a station by said vacuum means as a station passes said first selected position, said cutting means including a roller generally fixed in the direction of said path and engageable by said cutting edge as a station passes said first selected position; profile releasing means at a second selected, generally fixed position in said path and subsequently located in said path with respect to said first position for releasing a die cut profile for a station at said second position; transfer means at said second position for transferring a die cut profile from its station to said web of a coiled type storage bobbin; and, an auxiliary cutting means for cutting a predetermined portion of said profile overlying a predetermined portion of said die blade, said auxiliary cutting means including a member spaced from said path and means for forcing said member against said cutting edge of said predetermined portion of said die blade.

17. A device as defined in claim 16, including means for locating said auxiliary cutting means in said path and ahead of said first position.

18. A device as defined in claim 16, including means for locating said auxiliary cutting means in said path and behind said first position.

19. A device as defined in claim 16, wherein said member is a plunger with a resilient lower pad and said forcing means is a fluid operated cylinder receiving said plunger.

* * * * *

UNITED STATES PATENT AND TRADEMARK OFFICE

CERTIFICATE OF CORRECTION

PATENT NO. : 4,313,435

DATED : February 2, 1982

INVENTOR(S) : Frederick D. Godfrey, Jr.

It is certified that error appears in the above-identified patent and that said Letters Patent are hereby corrected as shown below:

Claim 1, column 8, line 14, after "passes" insert --said--. Claim 16, column 10, line 16, "blank" should read --blade--.

Signed and Sealed this

*Thirty-first* Day of *August 1982*

[SEAL]

*Attest:*

GERALD J. MOSSINGHOFF

*Attesting Officer*

*Commissioner of Patents and Trademarks*